US005203236A

United States Patent [19]

Anderson

[11] Patent Number: 5,203,236

[45] Date of Patent: Apr. 20, 1993

[54] LID STARTING APPARATUS AND METHOD

[76] Inventor: Scott M. Anderson, 9627 Highland Gorge, Beverly Hills, Calif. 90210

[21] Appl. No.: 936,947

[22] Filed: Aug. 28, 1992

[51] Int. Cl.[5] ..... B67B 7/18

[52] U.S. Cl. ..... 81/3.2; 81/3.31; 81/3.36; 81/3.43

[58] Field of Search ..... 81/3.07, 3.2, 3.31, 81/3.25, 3.33, 3.36, 3.29, 3.4, 3.42, 3.43, 57.33, 57.34, 57.35

[56] References Cited

U.S. PATENT DOCUMENTS

| | | | |
|---|---|---|---|
| 381,213 | 4/1888 | Christie | 81/3.43 |
| 1,953,412 | 4/1934 | Killman | 81/3.25 |
| 2,058,949 | 10/1936 | Borowski | 81/3.43 |
| 2,718,800 | 9/1955 | Olson | 81/3.43 |
| 2,793,550 | 5/1957 | Robinson et al. | 81/3.43 |
| 2,937,548 | 5/1960 | McKing | 81/3.43 |
| 3,280,664 | 10/1966 | Swanson | 81/3.43 |
| 3,293,957 | 12/1966 | Hofheins | 81/3.43 |
| 3,724,296 | 4/1973 | Graver | 81/3.25 |
| 3,950,801 | 4/1976 | Morrison | 81/3.2 |
| 4,171,650 | 10/1979 | Cardinal | 81/3.2 |
| 4,615,241 | 10/1986 | Grabarski | 81/3.2 |
| 4,833,948 | 5/1989 | Jones | 81/3.2 |
| 5,003,844 | 4/1991 | Barrow | 81/3.2 |

*Primary Examiner*—Roscoe V. Parker

*Attorney, Agent, or Firm*—Lawrence S. Cohen; Timothy T. Tyson

[57] ABSTRACT

A lid starter (20) is disclosed having a pair of belts (24, 26) to enclose respectively a lid (34) and a container (22) for starting an overtightened lid from the container. A first end of the lid belt is spring (66) biased to cooperate with a motor (76) coupled to pull the belt second end in applying torque to the lid. Rotatable arms (40, 124, 126) facilitate receiving the lid and container within the belts.

18 Claims, 10 Drawing Sheets

LID STARTING APPARATUS AND METHOD

FIELD OF THE INVENTION

The present invention relates generally to apparatus for opening containers and more particularly to apparatus for removing rotatable lids (e.g. threaded lids) from containers.

BACKGROUND OF THE INVENTION

Threaded lids are often overtightened and therefore difficult to manually remove from their containers. Apparatus intended to assist in such removal are described in U.S. Pat. Nos. 1,953,412; 2,058,949; 2,718,800; 2,837,947; 2,937,548; 3,280,664; 3,293,957; 3,724,296; 3,950,801; 4,171,650; 4,615,241; 4,833,948 and 5,003,844.

SUMMARY OF THE INVENTION

The present invention is directed to apparatus for starting overtightened lids from containers.

Apparatus in accordance with the invention are characterized by a belt connected to a pulling force at one end (e.g. a motor) and a resistive biasing force at the other end. The belt defines a loop to embrace the container lid and the resistive biasing force of the spring cooperates with the pulling force to apply a loosening torque through friction between the belt and the lid while the container is restrained from rotational movement.

In a preferred embodiment, one end of the belt is attached to a carrier slidably mounted within a base member and a spring is disposed to be compressed between the carrier and the base member. In another preferred embodiment the carrier is slidably mounted in an arm rotatably mounted from a base member to facilitate receiving the lid within the belt loop. In another preferred embodiment, a spring is connected to be extended between one end of the belt and the rotatable arm.

In a preferred embodiment, the container is restrained from rotational movement with a container belt looped from a container arm also rotatably mounted on the housing. The container belt is fixed at one end to the container arm and pulled to the container arm from the other end.

The novel features of the invention are set forth with particularity in the appended claims. The invention will be best understood from the following description when read in conjunction with the accompanying drawings.

MODES FOR CARRYING OUT THE INVENTION

Figure 1:
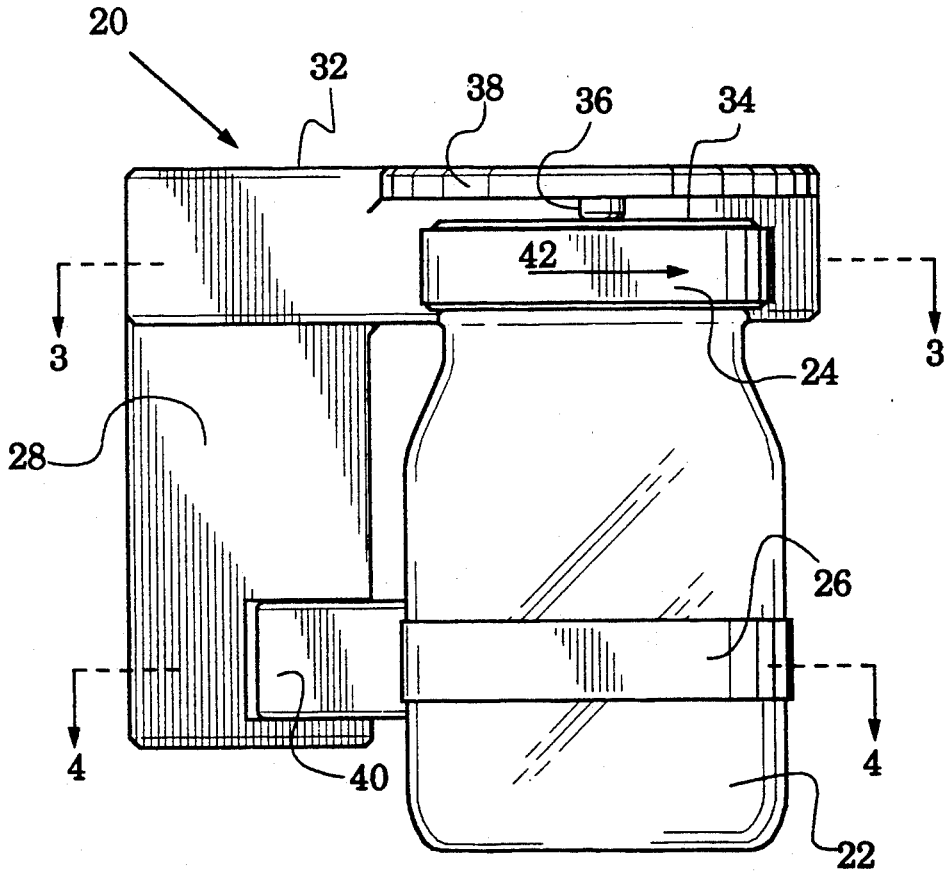
FIG. 1 is a front elevation view of a preferred lid starter embodiment, in accordance with the present invention, with a container placed therein.
Figure 2:
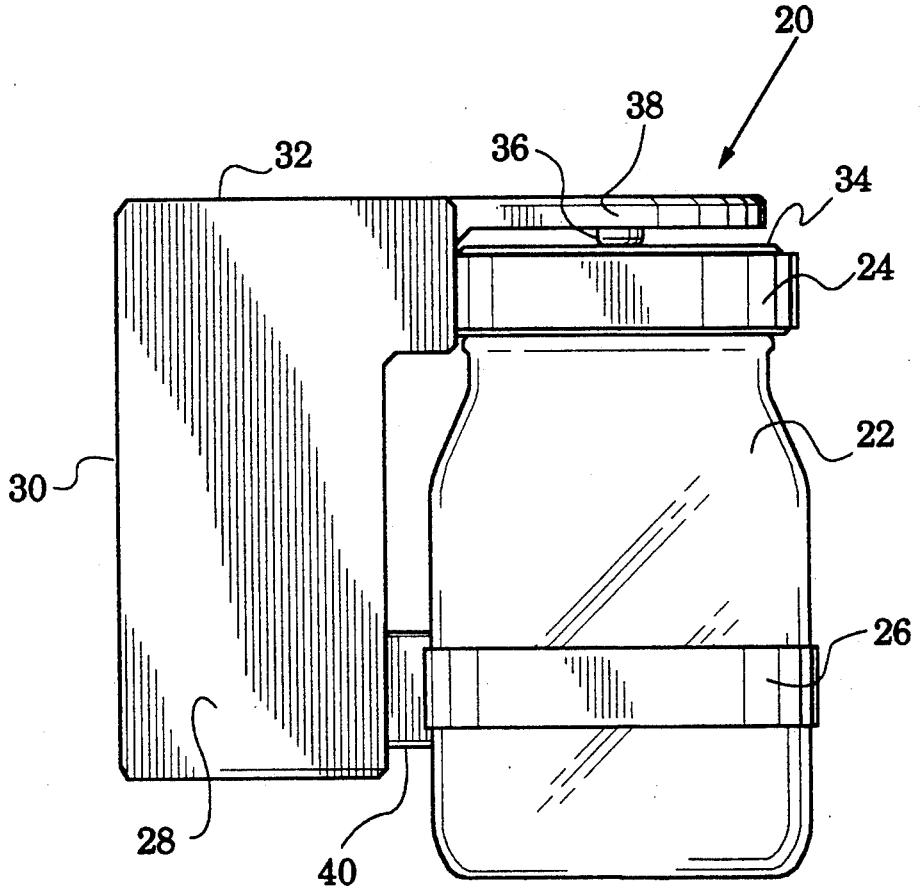
FIG. 2 is a side elevation view of the starter of FIG. 1.

A preferred lid starter embodiment 20, in accordance with the present invention, is illustrated in the front and side elevation views respectively of FIGS. 1 and 2 with a container 22 installed within belts 24, 26 extending from a base member in the form of a housing 28. In this embodiment the housing 28 is configured to be mounted by its back surface 30 (e.g. against a kitchen wall) or by its top surface 32 (e.g. under a kitchen countertop).

The belts 24, 26 have sufficient stiffness to define receiving loops and in use, a container 22 is inserted upwards into these loops until the container lid 34 depresses a starter button 36 mounted in a protruding housing shelf 38. The belts 24, 26 are then automatically pulled about respectively the lid and container with the aid of pulling mechanisms (e.g. electric motors) within the housing 28.

The container belt 26 firmly grips the container 22 against an arm 40 which is rotatably mounted to the housing 28 while the lid belt 24 applies a torque, with the aid of resistive biasing within the housing 28 (described in detail below), to the lid 34 in the direction 42 (shown in FIG. 1) to start it from the container 22.

Although intended primarily to start over-tightened lids from containers of variable sizes, the starter 20 can be recycled a number of times to completely remove the lid 34. Alternatively, once the lid 34 has been started the container and lid can be removed from the starter 20 for subsequent manual removal of the loosened lid. The belts 24, 26 may be dimensioned to accommodate a wide range of container and lid diameters with the rotatable arm 40 facilitating alignment of the belts.

Figure 3:
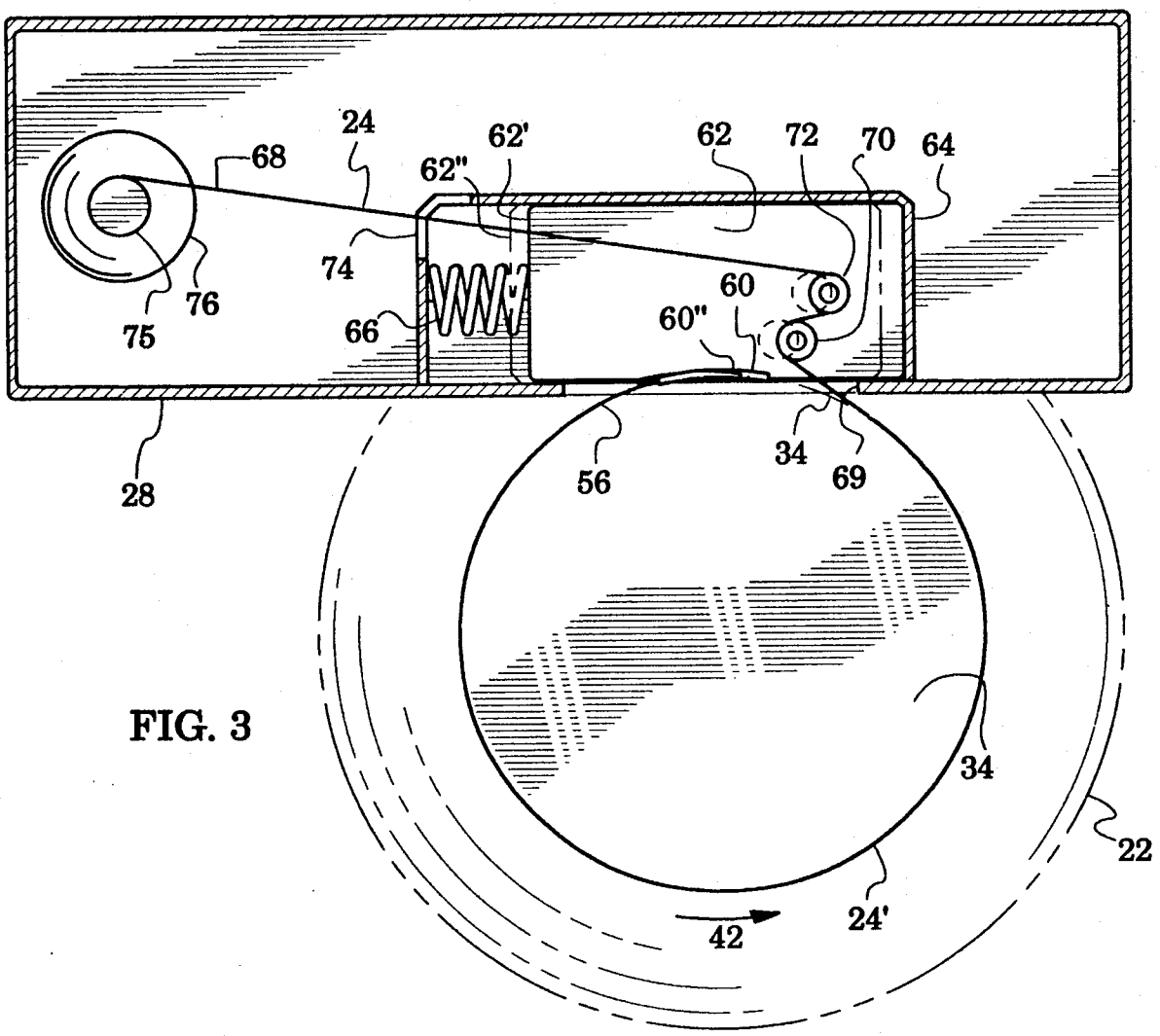
FIG. 3 is a view along the plane 3—3 of FIG. 1.
Figure 4:
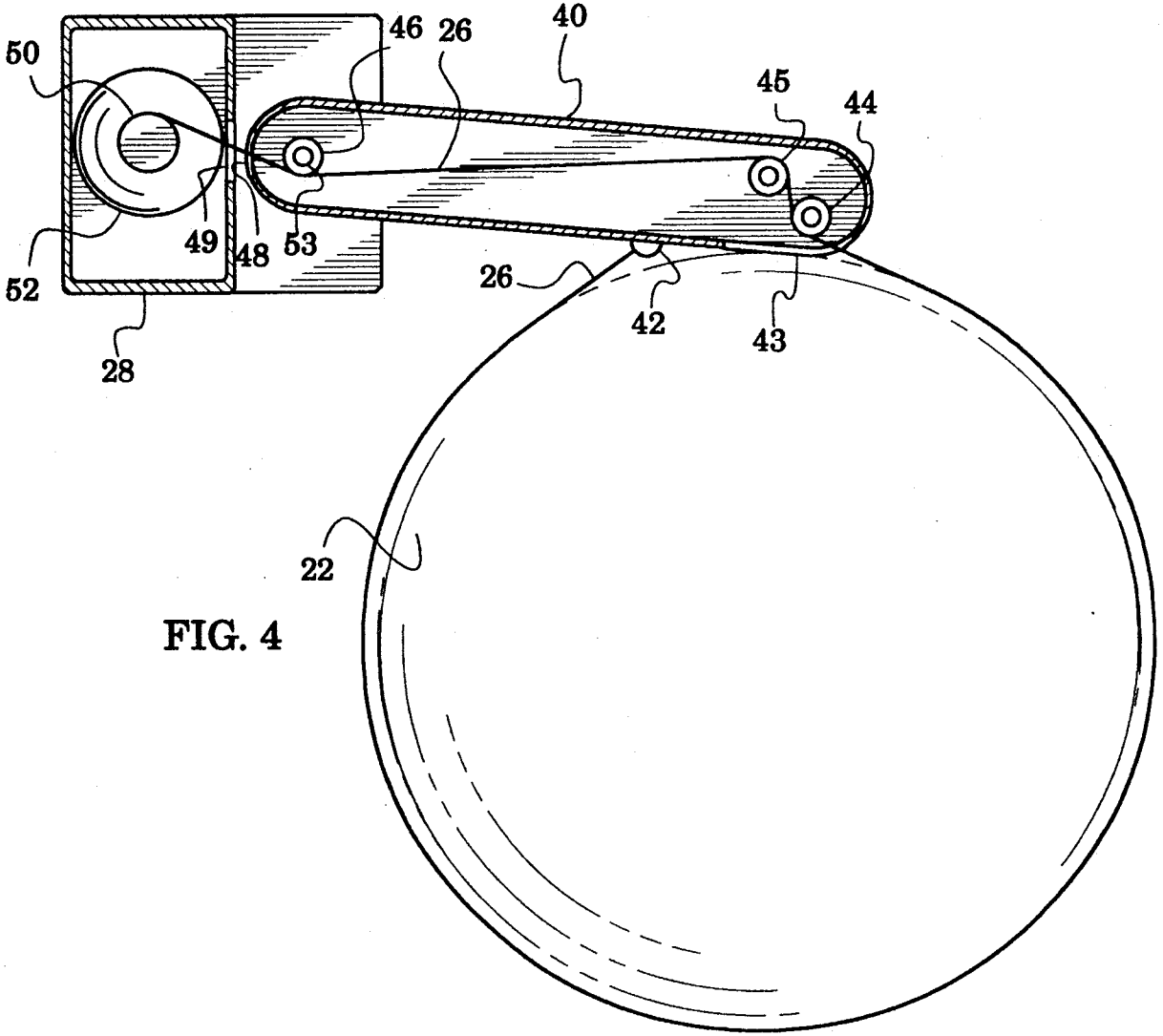
FIG. 4 is a view along the plane 4—4 of FIG. 1.

The starter 20 is now described in detail with reference to FIGS. 3, 4 which are respectively sectional views along the planes 3—3 and 4—4 of FIG. 1. For clarity of illustration, both FIGS. 3 and 4 show the container 22 and lid 34 in phantom outline. As seen in FIG. 4, the container 22 is received within a loop defined by the container belt 26 which is secured at one end via a boss 42 to the arm 40. The other end of the container belt 26 is led through a slot 43 defined by the container arm 40, past rollers 44, 45 and 46 and through an arm slot 48 and housing slot 49 to be wound about a shaft 50 driven by an electric motor 52 mounted within the housing 28. The arm 40 and the roller 46 each rotate about a pin 53 mounted in the housing 28.

Winding the container belt 26 about the shaft 50 causes the container 22 to be gripped between the belt 26 and the container arm 40 to restrain its rotation relative to the starter 20. The tension of the belt 26 may be appropriately adjusted and maintained by methods well known in the art (e.g. a slip clutch in the shaft 50, a motor switch responsive to a strain gage in the belt).

FIG. 3 illustrates that a first end 56 of the lid belt 24 terminates in a resilient pad 60 configured with a concave surface to conform to container lids 34. The pad 60 is mounted on a carrier 62 which is slidably mounted within the housing 28. The carrier 62 is urged to a rest position 62' abutting the divider wall 64 by a biasing member in the form of a spring 66 disposed between the carrier 62 and the housing 28. The second end 68 of the lid belt 24 is led through a housing slot 69, past rollers 70, 72 on the carrier 62, through a slot 74 defined by the divider wall 64 and wound about a shaft 75 of an electrical motor 76.

After the motor 76 has pulled the belt 24 firmly about the lid 34, it is then rotated further to pull the belt second end 68 a predetermined distance to move the carrier 62 and attached pad 60 to respective lid started positions 62" and 60" as shown in phantom outline in FIG. 3. Thus the pad 60 and belt portion 24' in contact with the lid 34 move in the circumferential direction 42 to rotate the lid relative to the container 22 which is held fixed by the belt 26 (as shown in FIG. 4).

The spring 66 is compressed between the carrier 62 and the housing 28 and the resistive biasing of the spring 66 tightens the belt 24 to enhance its grip upon the lid 34. The motor 76 thus cooperates with spring 66 biasing to apply torque to the lid 34 via friction between the belt 24 and the lid 34. The pad 60 increases the friction between the belt 24 and lid 34.

Figure 5:
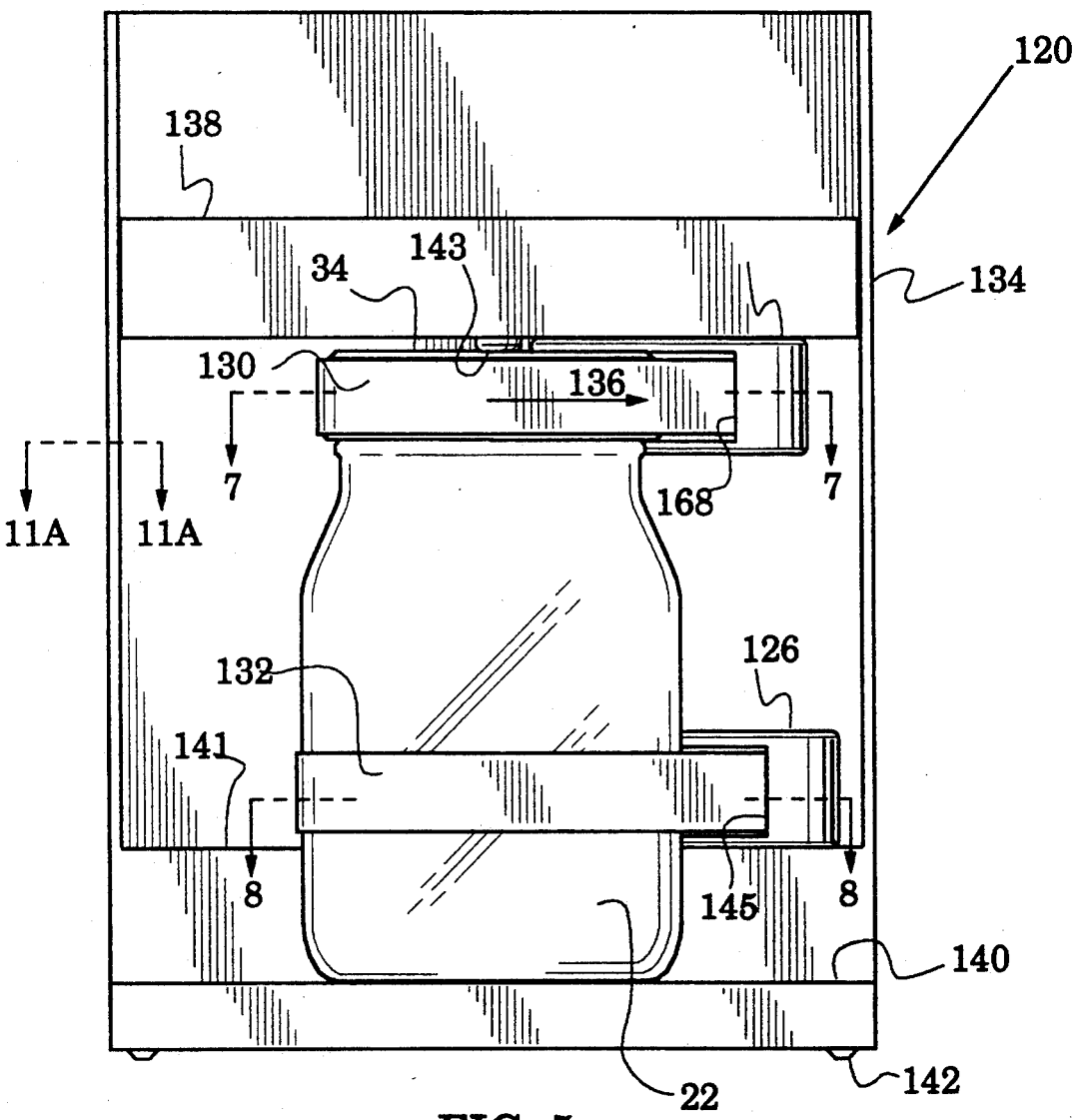
FIG. 5 is a front elevation view of another preferred screw lid starter embodiment with a container placed thereon.
Figure 6:
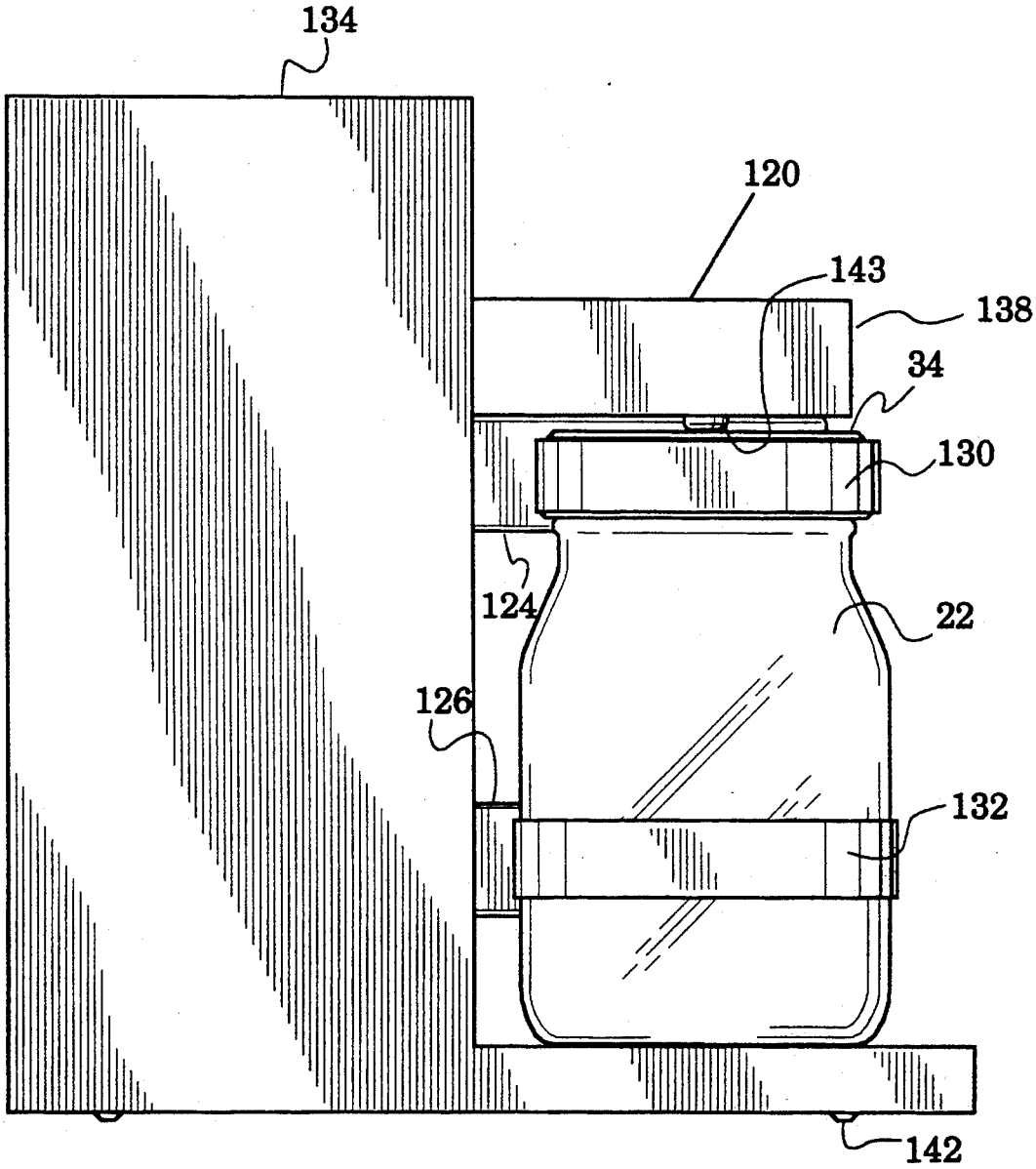
FIG. 6 is a side elevation view of the starter of FIG. 5.

Another preferred lid starter embodiment 120 is illustrated in the front and side elevation views respectively of FIGS. 5 and 6 with a container 22 installed therein. Rotatable arms 124, 126 are shown abutting respectively the container lid 34 and container 22. A belt 130 extends from the lid arm 124 to enclose the lid 34 while another belt 132 extends from the container arm 126 to enclose the container 22. The belts 130, 132 are pulled about the lid and container respectively with the aid of electric motors within the housing 134. Once the container belt 132 has been pulled into the container arm 126 to secure the container 22 against the container arm, the lid belt 130 is pulled against spring biasing in the direction 136 to apply torque to the lid 34.

The lid arm 124 is mounted on an adjustable shelf 138 which slides vertically and the container arm 126 is mounted on a fixed shelf 141 defined by the housing 134. After a container is positioned through the loop defined by the container belt 132 to rest on the housing floor 140, the shelf 138 can be lowered to position the lid belt 130 over the container lid. Contact between the lid 34 and a starter button 143 mounted in the shelf 138 activates the starter 120. The arms 124, 126 rotate outward to accommodate a variety of lid and container sizes. The housing is provided with feet 142 to rest on a countertop.

Figure 8:
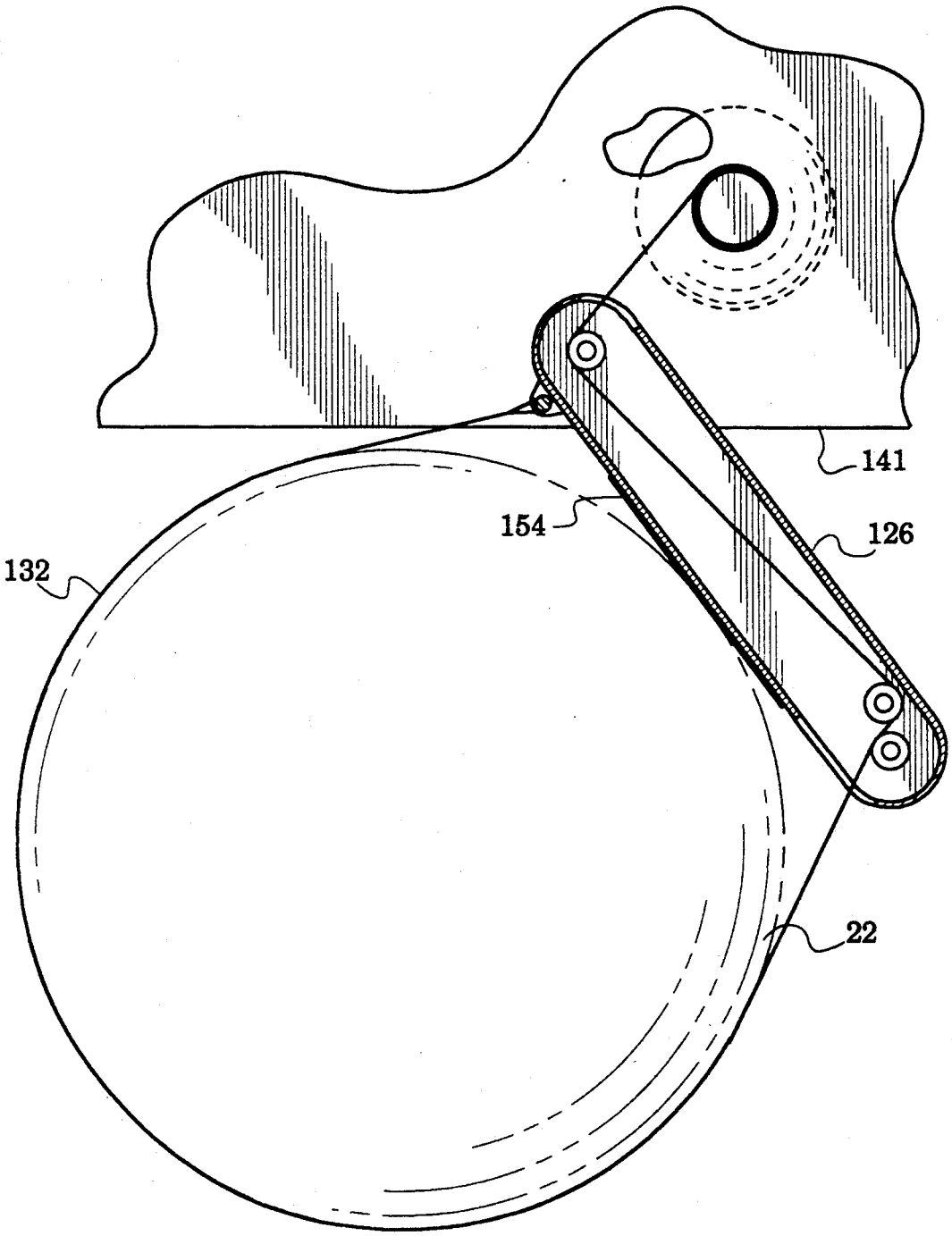
FIG. 8 is a view along the plane 8—8 of FIG. 5.

As seen in FIG. 8 which is a view along the plane 8—8 of FIG. 5, the container 22 is secured against the arm 126 in a manner similar to that described above for the starter 20 (see FIG. 4). A pad 154 may be fixed to the arm 126 to enhance frictional contact with the container 22.

Figure 7:
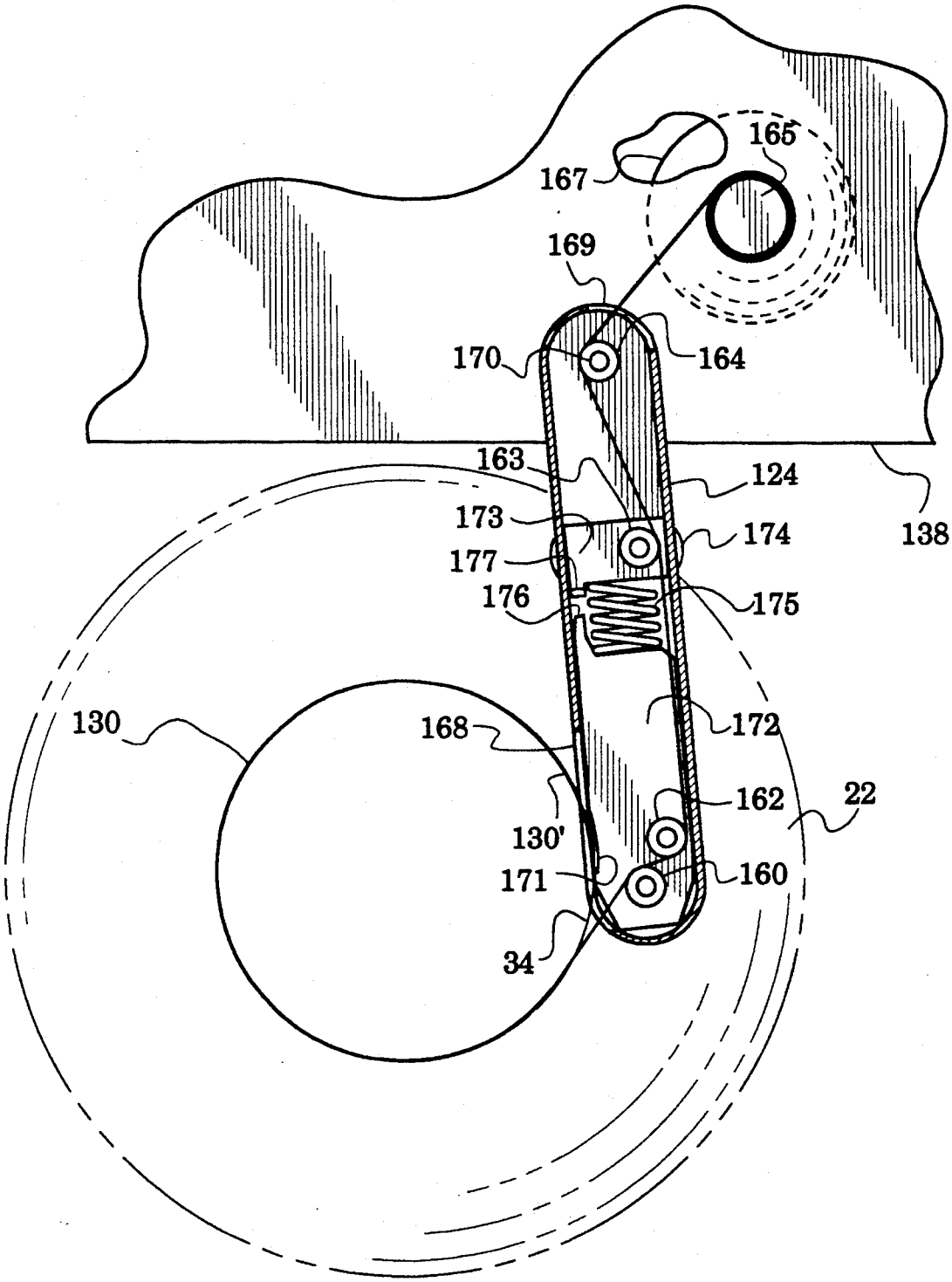
FIG. 7 is a view along the plane 7—7 of FIG. 5.

FIG. 7 illustrates, for the starter 120, functions similar to those within the housing 28 of the starter 20 (see FIG. 3). One end of the lid belt 130 is tightened about the lid 34 with the aid of rollers 160, 162, 163 and 164 and shaft 165 driven by lid electric motor 167 mounted on the adjustable shelf 138. The lid belt 130 is led through lid arm slots 168, 169. The lid arm 124 and the roller 164 both rotate about a pin 170 mounted in the adjustable shelf 138.

The belt end 130' terminates in a pad 171 fixed to a carrier 172 which is free to slide within the lid arm 124. A block 173 is fixed within the arm 124 with fasteners 174 and a biasing member in the form of a helical spring 175 urges the carrier 172 away from the block 173 to abut the inner end of the arm 124. The rollers 160, 162 are rotatably mounted on the slidable carrier 172 while the roller 163 is rotatably mounted on the fixed block 173 to facilitate passing the lid belt 130 past the spring 175.

In operation the spring 175 is compressed between the carrier 172 and the pad 171 and the resistive biasing force of the spring 175 cooperates with the pulling force of the motor 167 to apply torque to the lid 34 in a manner similar to that of the starter 20 as shown in FIG. 3. The carrier 172 defines a tab 176 on one end which abuts a contact switch 177 mounted on the block 173 to break electrical current flow to the motor 167 when a predetermined circumferential travel of the belt 130 and lid 34 has been achieved.

Figure 9:
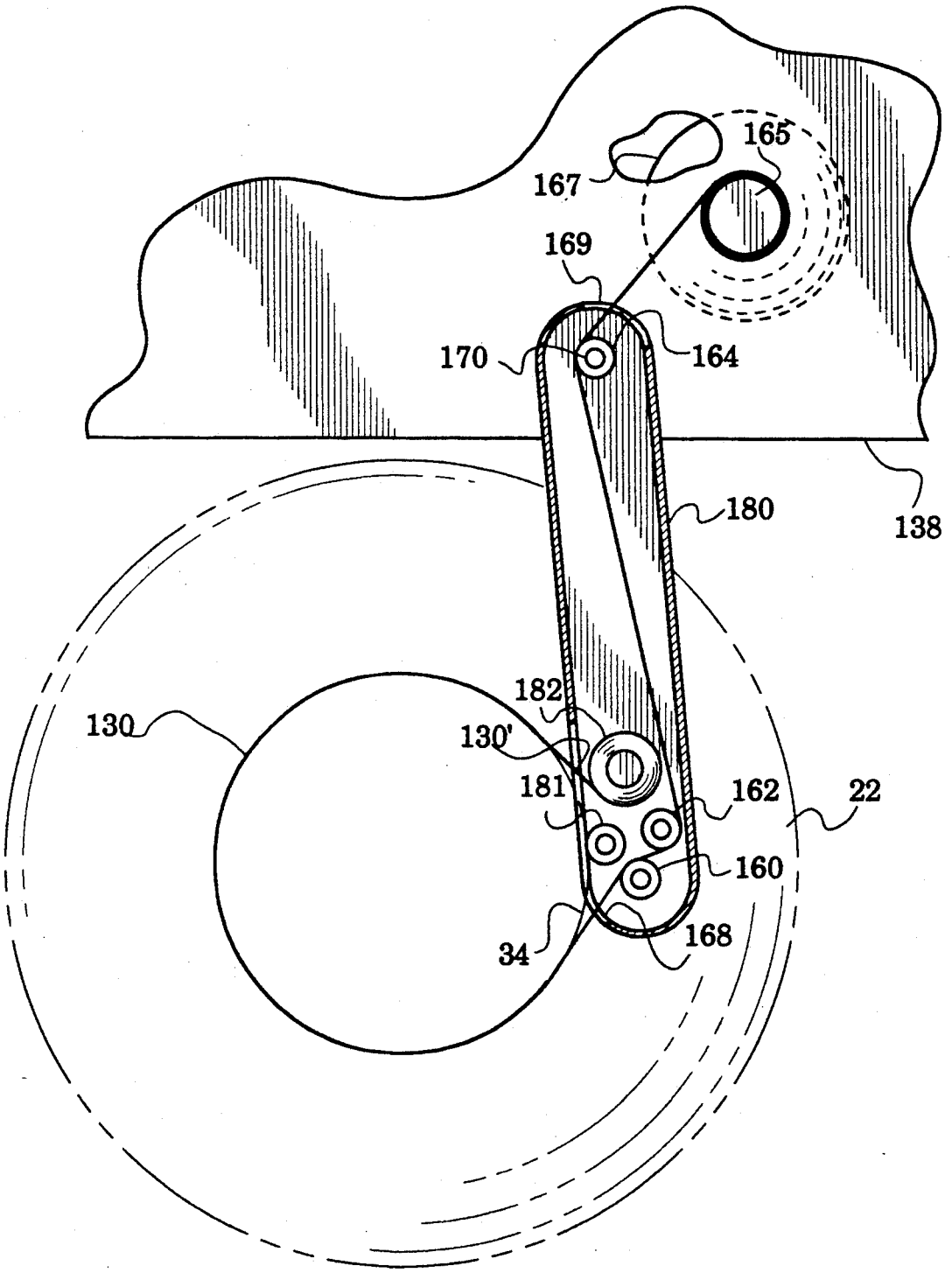
FIG. 9 is view similar to FIG. 7 illustrating another preferred starter embodiment.

FIG. 9 illustrates another preferred embodiment of the lid belt 130 resistive loading in the lid arm 180. In the arm 180 the rollers 160, and 162 are rotatably mounted on the arm 124 while an additional roller 181, also mounted on the arm 124, rotatably abuts the lid 34 to reduce friction therebetween. The end of the lid belt 130 is secured to the lid arm 124 via a biasing member in the form of a coil spring 182. As in the embodiment illustrated in FIG. 3, the resistive biasing force of the spring 182 (resulting from the spring 182 being extended between the lid belt 130 and the arm 124) cooperates with the pulling force of the motor to apply torque to the lid 34 via friction between the lid 34 and lid belt 130.

Figure 10:
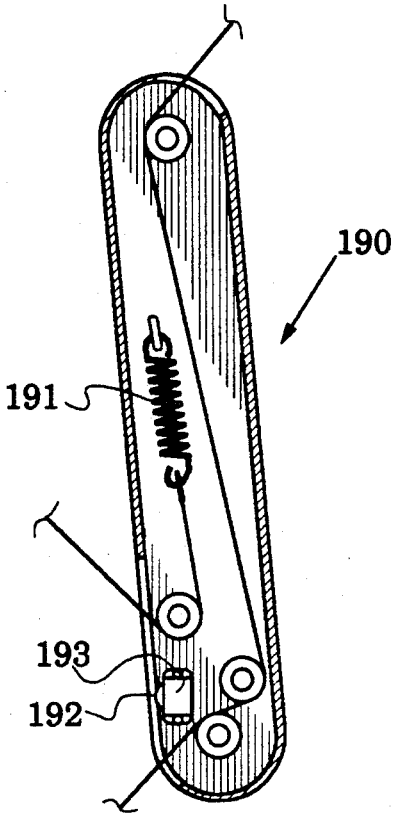
FIG. 10 is a view similar to a portion of FIG. 9 illustrating another preferred starter embodiment.

FIG. 10 illustrates another preferred embodiment of the lid belt 130 resistive loading in the lid arm 190 which employs a helical spring 191 in tension and a ball 192 rotating within a race 193 to perform the functions respectively of the coil spring 182 and roller 181 of the lid arm 124 shown in FIG. 9.

Figure 11A:
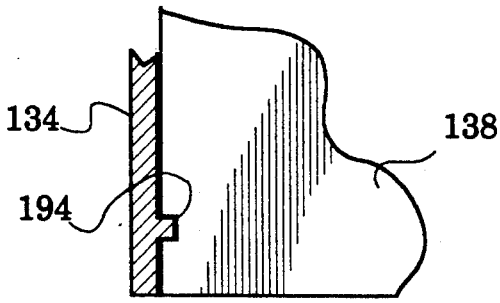
FIG. 11A is a view along the plane 11A—11A of FIG. 5.
Figure 11B:
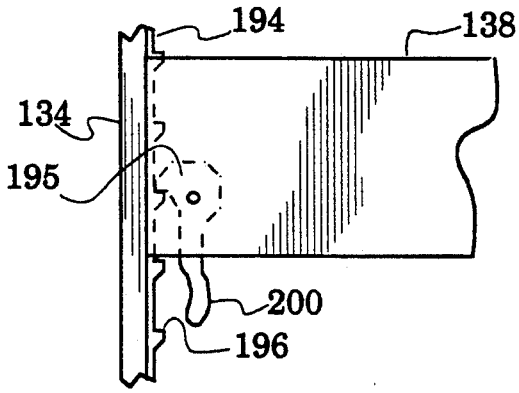
FIG. 11B is a front elevation view of the structure of FIG. 11A.

FIG. 11A is a view along the plane 11A–11A of FIG. 5 and FIG. 11B is an elevation view of the structure of FIG. 11A. These views illustrate how the adjustable shelf 138 moves vertically along ribs 194 and is set thereon by a pawl 195 which engages notches 196 in the ribs 194. The pawl 195 is spring biased and may be released by pressure on a handle 200. Movement of the adjustable shelf may be enhanced by methods well known in the art (e.g. the weight of the shelf may be counterbalanced with weights or springs).

Figure 12A:
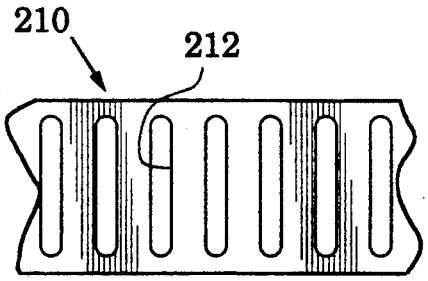
FIG. 12A is a front elevation view of a preferred starter belt embodiment.
Figure 12B:
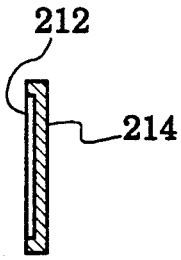
FIG. 12B is a sectional view of the belt of FIG. 12A.
Figure 13A:
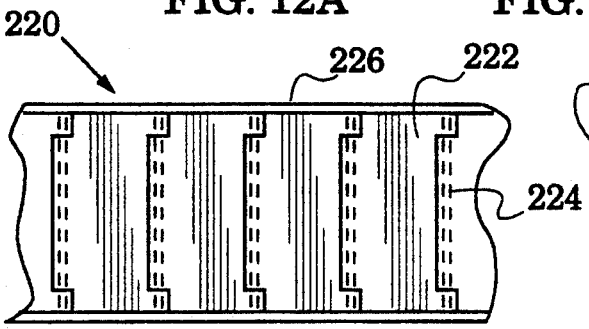
FIG. 13A is a front elevation view of another preferred starter belt embodiment.
Figure 13B:
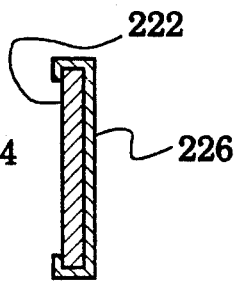
FIG. 13B is a sectional view of the belt of FIG. 13A.

To aid the belts 24, 26, 130, 132 in defining loops to receive the lid 34 and container 22, as shown in starters 20, 120, they may be vertically stiffened by defined ribs 212 as illustrated in the belt 210 of FIGS. 12A, 12B. The belt 212 is fabricated from a resilient material (e.g. a polymer) with a surface 214 defining irregularities to enhance frictional contact with a lid or container. Another belt embodiment 220, shown in FIGS. 13A, 13B, is vertically stiffened by articulated metal segments 222 rotatably connected by pins 224. The segments 222 are partially enclosed in a resilient backing 226.

Although, in the preferred embodiments, a single container belt, e.g. belt 26 in FIG. 1, has been described to restrain rotation of a container while its lid is started, it should be understood that the teachings of the invention generally include a plurality of container belts for container restraint. To facilitate lid starting by the lid belt, e.g. belt 24 in FIG. 1, the container belts restrain any transverse (e.g. tilting) or longitudinal movement of the container axis as well as movement about its axis (rotating). Such plurality of belts may include a belt spaced from the container belt described in the preferred embodiments (e.g. located adjacent the lid belt) to enhance the restraint system longitudinal leverage on the container.

In addition, although in the preferred embodiments movement along the container longitudinal axis to enhance accomodation of a variety of container sizes has been described only for the lid belt, e.g. belt 130 in FIG. 5, it should be understood that the teachings of the invention generally include longitudinal adjustment of any or all lid and container belts.

From the foregoing it should now be recognized that lid starter embodiments have been disclosed herein especially suited to starting overtightened lids having a variety of diameters from a variety of sized and configured containers.

The preferred embodiments of the invention described herein are exemplary and numerous modifications, dimensional variations and rearrangements can be readily envisioned to achieve an equivalent result, all of which are intended to be embraced within the scope of the appended claims.

What is claimed is:

1. Apparatus for starting a lid from a container, comprising:

a base member;

a lid belt arranged in a loop to receive said lid;

a resistive biasing member coupled between said base member and a first end of said lid belt and arranged to apply a resistive biasing force to said first end;

a pulling mechanism coupled between said housing and the second end of said lid belt to apply a pulling force thereto having a magnitude greater than said resistive biasing force; and a container belt coupled to said base member and arranged about said container for rotational restraint thereof relative to said base member.

2. The apparatus of claim 1 further comprising a carrier slidably mounted to said base member and attached to said lid belt first end and wherein said resistive biasing member comprises a spring disposed between said base member and said carrier to be compressed therebetween when said pulling mechanism applies said pulling force.

3. The apparatus of claim 1 wherein said resistive biasing member comprises a spring attached between said base member and said lid belt first end to be extended therebetween when said pulling mechanism applies said pulling force.

4. The apparatus of claim 1 further comprising a lid arm rotatably mounted to said base member, said lid belt coupled through said lid arm to facilitate receiving said lid within said lid belt loop.

5. The apparatus of claim 1 further comprising a container arm rotatably mounted to said base member, said container belt coupled through said container arm to facilitate receiving said container.

6. The apparatus of claim 2 wherein said spring comprises a helical spring.

7. The apparatus of claim 3 wherein said spring comprises a helical spring.

8. The apparatus of claim 3 wherein said spring comprises a coil spring.

9. The apparatus of claim 1 wherein said pulling mechanism comprises a motor.

10. A method for starting a lid from a container, comprising the steps of:

providing a base member;

arranging a lid belt in a loop to receive said lid;

coupling a resistive biasing member between said base member and a first end of said lid belt to apply a resistive biasing force thereto;

coupling a pulling mechanism between said base member and the second end of said lid belt to apply a pulling force thereto having a magnitude greater than said resistive biasing force; and coupling a container belt from said base member about said container for rotational restraint thereof.

11. The method of claim 10 wherein said resistive biasing member coupling step comprises the steps of:

slidably mounting a carrier to said base member;

connecting said carrier to said lid belt first end; and disposing a spring between said carrier and said base member to be compressed therebetween when said pulling mechanism applies said pulling force.

12. The method of claim 10 wherein said resistive biasing member coupling step comprises the step of connecting a spring between said base member and said lid belt first end to be extended therebetween when said pulling mechanism applies said pulling force.

13. The method of claim 1 further comprising the steps of:

mounting a lid arm rotatably to said base member; and coupling said lid belt through said lid arm to facilitate receiving said lid within said lid belt loop.

14. The method of claim 10 wherein said container belt coupling step comprises the steps of:

mounting a container arm rotatably to said base member; and coupling said container belt through said container arm to facilitate receiving said container.

15. The method of claim 11 wherein said spring comprises a helical spring.

16. The method of claim 12 wherein said spring comprises a helical spring.

17. The method of claim 12 wherein said spring comprises a coil spring.

18. The method of claim 10 wherein said pulling mechanism comprises a motor.

* * * * *